United States Patent [19]

Schlick et al.

[11] 4,272,112

[45] Jun. 9, 1981

[54] ELECTRIC DOOR LOCK FOR MOTOR VEHICLES

[75] Inventors: Horst Schlick, Schwalbach; Karl Rau, Mühlheim; Alfred Wipfler, Kriftel; Joachim Lueg-Althoff, Hofheim, all of Fed. Rep. of Germany

[73] Assignee: VDO Adolf Schindling AG, Frankfurt am Main, Fed. Rep. of Germany

[21] Appl. No.: 45,308

[22] Filed: Jun. 4, 1979

[30] Foreign Application Priority Data

Jun. 9, 1978 [DE] Fed. Rep. of Germany ..... 2825355

[51] Int. Cl.[3] ..... E05C 13/04

[52] U.S. Cl. ..... 292/201; 292/199

[58] Field of Search ..... 292/144, 142, 172, 199, 292/201

[56] References Cited

U.S. PATENT DOCUMENTS

| | | | |
|---|---|---|---|
| 2,898,138 | 8/1959 | Van Noord | 292/201 X |
| 3,566,703 | 3/1971 | Van Noord | 292/201 X |
| 4,126,341 | 11/1978 | Bradstock | 292/201 |
| 4,135,377 | 1/1979 | Kleefeldt et al. | 292/201 X |

*Primary Examiner*—Richard E. Moore

*Attorney, Agent, or Firm*—Otto John Munz

[57] ABSTRACT

An apparatus is disclosed for electrically locking the doors of motor vehicles, wherein at least one motor is supported in a driver door and the motor is coupled with a lock mechanism by means of a connecting element, with a first switch coupled with the motor to be actuated thereby and a second switch coupled with the lock mechanism to be actuated thereby and also coupled with the first switch and with the motor, and the switches are connected with at least one additional motor coupled with a further lock mechanism. Structure is included to change the direction of the force exerted by the motor on the lock mechanism, for locking or unlocking the doors, respectively. The invention is characterized in that both the first switch and the second switch are arranged in a structural unit or housing attached to the motor, which housing contains an activating mechanism with activating elements to activate the first and second switches, the activating elements being part of a gear train forming a force flow path between the motor and the connecting element, and the gear train being constructed to reverse the direction of movement of the connecting element in dependence on the rotation completed by the motor. The connecting element is coupled with the motor by means of a lost motion connection via the activating element of the second switch.

14 Claims, 8 Drawing Figures

ELECTRIC DOOR LOCK FOR MOTOR VEHICLES

BACKGROUND OF THE INVENTION

The invention relates to an apparatus for centrally controlling the locking of motor vehicles via electric motor means, with at least one motor in a driver door being coupled with a lock mechanism by means of a connecting element. A first switch is arranged on the motor and is coupled therewith and a second switch is coupled with the lock mechanism, all of which are electrically connected with each other and with the motor and can be connected with at least one further motor coupled with a further lock mechanism. Means for reversing the direction of the force exerted by the motor on the lock mechanism is also provided.

In motor vehicles with high comfort demands, central locks are often employed which lock or unlock all other doors when the lock of the driver door is activated. Other locks can also be coactivated in the same manner, as for example, the rear lid, the hood and the lid over the tank filling pipe.

PRIOR ART

A known apparatus for electric motor central locking of motor vehicles of the above-described type includes a switch coupled with the lock mechanism, which is formed as a reversing switch and is arranged directly on the lock mechanism. An additional switch, which is also formed as a reversing switch, is coupled with the motor in order to perform an end switch if the motor has completed the necessary rotational path to lock or unlock the lock and in order to prepare for a renewed manual activation of the lock.

The switch arranged on the lock, which is here designated as the second switch, and the switch arranged on the motor, which is here designated as the first switch, are connected with each other in such a manner that they form an alternating circuit. These operate in such a manner that when the second switch is activated the motor is placed in motion to unlock the lock, for example, and the motor, after the lock has reached the unlocked position, is stopped by the first switch, whereby the first switch closes a contact which becomes effective upon renewed activation of the second switch on the lock, to activate the lock in the desired direction by the motor. With the simple mechanical connection of the motor shaft with the lock mechanism belonging to the prior art, a reversing switch must also be provided in the electrical arrangement of the two switches and the motor, in order to allow the motor to rotate in a first rotational direction to unlock the lock and in a second rotational direction to lock the lock. The reversing can be effected by a reversing pole switch which is activated according to the lock activation.

This known apparatus for electric motor central locking is relatively expensive to produce, so that as a rule they are reserved for only relatively expensive automobiles. The manufacturing expense is relatively high because the first switch, which is activated according to the rotational path of the motor, is arranged directly on the motor, while the second switch activated by the lock mechanism, and the pole reversing switch, are located on the lock. A substantial expense for wiring is necessary to connect this switch. It is thus not only the manufacture of the structural groups of the electric motor central locking apparatus that is actually relatively expensive, but also the mounting of these structural groups in the door of the automobile.

SUMMARY OF THE INVENTION

The basic objective of the present invention is to further develop the electric motor central locking apparatus while avoiding the disadvantages of the known electric motor central locking apparatus in such a manner that the manufacturing expense of the components to be built into the automobile is reduced and the mounting of the components in the automobile is also simplified.

This objective is accomplished according to the invention for an apparatus for electric motor central locking of the above-described type in that in addition to the first switch, the second switch is arranged in a structural unit surrounding the motor, which unit includes an activating mechanism with activating elements for activating the switches, as well as a force flow path between the motor and the gearing means forming the connecting element, which gearing means are formed to reverse the direction of movement of the connecting element in dependence on the rotational path completed by the motor and that the connecting element connected with the activating element of the second switch is coupled with the motor by a lost motion connection.

The apparatus for electric motor central locking thus basically comprises only one component, i.e. the structural unit in which the electric motor and the switches with their activating mechanisms and gearing means are located, which unit is to be coupled with the lock mechanism by means of a connecting element, such as a connecting rod.

This connecting element not only transmits the force for locking and unlocking of the locks to the lock mechanism from the motor, but also defines the path for controlling the second switch caused by the manual closing of the lock. The activation of the second switch, as with central locking, can thereby be transferred in the usual manner with little force, because as a result of the lost motion connection, the coupling between the connecting element and the motor and preferably also the gearing elements directly connected with the motor is eliminated, so that the rotor of the motor and these gearing elements are not carried along during a stroke of the connecting element. The basic advantage of this apparatus is the compact embodiment in a structural unit which leads to a saving of elements for the activation of the switches, and preferably also leads to the integration of switch elements themselves in the structural unit, as well as in the simple mounting of this structural unit in the door and also in a substantial reduction of the wiring expense, particularly in the doors, which can be manually activated with keys. A further substantial advantage is to be seen in the fact that a pole reversing switch which was previously necessary to change the direction of the force acting on the lock mechanism by reversing the poles of the motor is done away with, because the direction reversal takes place automatically through the gearing means in dependence on the rotational path completed by the motor.

An advantageous embodiment of the apparatus has the characteristics that the activating mechanism includes a disc which activates the second switch, and can be rotated by the degree corresponding to the looseness or play with respect to a gearing element which activates the first switch, which gearing element is engaged in the force flow path between the motor and the connecting element. This embodiment is advantageous because the elements which can be moved against each other are formed to perform rotational movements. The manufacture of this disc and the associated gearing elements is relatively simple and in operation the elements experience little wear. In detail, the elements forming the loose connection are constructed in such a manner that a bolt projects axially out of the gearing element and the disc is formed as a half-disc with a stop surface for the bolt. In this particularly simple embodiment, the stop surface on the half-disc can be moved away from the bolt by a relatively large, uncritical distance, in order to activate the second switch, whereafter the bolt is rotated by the motor against the stop surface in order to rotate the half-disc to complete a rotational angle to activate the lock.

In another special embodiment of the disc forming the loose connection with the bolt projecting from the gearing element, the bolt extends into an arcuate slot formed in a full disc. The looseness herein is determined by the dimensions of the slot, one end of which, like the above-described stop surface, serves to carry along the disc by means of the bolt rotated by the motor.

A particularly simple embodiment of the present apparatus has the characteristic that the gearing element which activates the first switch is formed as a gear of a gear drive which connects the motor with a drive shaft. In this embodiment of the apparatus, no further measures need be taken in order to activate the first switch for the end cut-off after the rotational path of the motor has been completed to the desired degree, because the gear of the gear drive carries a cam for the activation of a microswitch, or itself serves as a contact carrier of the first switch effecting the cut-off.

In a particularly effective embodiment of the apparatus, a crank is arranged on the drive side of the gearing, on which the connecting element acts to effect a reversal of the direction of movement. The crank very simply and inexpensively effects the reversal of the direction of movement of the connecting element activating the lock mechanism when the angle of rotation of the crank exceeds the upper or lower dead center. Thus no electrical reversal of the motor effecting the drive is necessary.

In a further special embodiment, the apparatus has the characteristic that a second bolt projects from the gearing element at an angular distance from the first bolt. The looseness or lost motion is determined by the angular distance between the first bolt and the additional bolt. It is possible in this case to operate the lock associated with this lock mechanism manually in emergency situations when there is a failure of the electric motor drive of the lock mechanism. For this purpose, the half-disc strikes against the second bolt after the half-disc has left contact with the first bolt and has completed a predetermined path, at the completion of which the second switch can be manually activated by the half-disc without great exertion of force, because the gearing and the motor need not be carried along by the manual activation of the lock mechanism. Only when the half-disc strikes the second pin do greater forces need to be used in the manual activation of the lock in the present example, so that the rotation of the half-disc effects a rotation of the gearing element from which the second bolt projects, whereby the first switch, activated by the gearing element, is brought into the desired switch position after the lock mechanism is manually set in the desired position. Thus, a renewed automatic locking is possible in a subsequent activation of the lock, if the damage in the electrical system has been corrected. Similarly, the other lock mechanisms electrically coupled with this lock mechanism also function in an undisturbed manner when in the present case the one lock mechanism is activated manually.

In a further variation of the apparatus, the characteristics are provided for the reversal of the direction of movement of the connecting element in dependence on the rotational path completed by the motor and for the producing of the looseness of lost motion between the activating element of the second switch and the connecting element, wherein the connecting element ends in a portion provided with a guide slot, and a lever arm engages in the guide slot, which lever arm is connected with a shaft driven by the motor by means of the gearing, and the portion provided with the guide slot is formed as an activating element to activate the second switch. Thus, in this variation the disc or half-disc for cooperation with one or two pins is eliminated, and also eliminated is the need for a special crank to reverse the direction of movement of the connecting element in dependence on the rotational path of the motor. Instead, the portion provided with the guide slot and the lever arm form a lost motion connection in two sections of the guide slot, so that when the lock mechanism is manually activated the connecting element can activate the second switch without carrying along the crank element, whereupon the lever arm runs into a nearly V-shaped connecting section by means of the rotation of the crank element with the electric motor, in which connecting section the lever arm carries along the connecting element nearly in the longitudinal direction of the connecting element as the lever arm is rotated further. When, accordingly, in the end position of the connecting element the lever arm engages in a second section of the guide slot oriented in the direction of movement of the connecting element, the connecting element is pushed in the opposite sense until the crank has reached a point of dead center and the lever arm engages in a further portion of the guide slot. With further movement of the lever arm in the same rotational direction as before the lever arm arrives in a second nearly V-shaped section of the guide slot and carries along the connecting element in the opposite sense as before in an end position.

In this manner, a reversal of the second switch takes place in order to prepare the next rotation of the electric motor. The connecting element is driven back into its original position, whereafter the crank element arrives in its original position in the guide slot. This results in an especially compact construction of the apparatus according to the invention. In detail, the apparatus with the above-described guide slot advantageously has the characteristics that the guide slot has two adjacent slot sections arranged nearly parallel to the main direction of movement of the connecting element and two nearly V-shaped connecting sections connecting them.

Because of the fact that the structural unit including the two switches also contains an activating mechanism with activating elements for activating the switches lies within the general principle of the present invention, this apparatus is advantageously further constructed with components of both switches integrated in the gearing means.

Thus, in this case complete switches do not need to be placed in the structural unit, i.e. microswitches, but rather the gearing means themselves are modified and supplemented to form switches. In this manner, the expense for manufacture of the apparatus can be further reduced. In addition, this makes possible a particularly space-saving construction.

In detail, an apparatus in which both switches are integrated may comprise an annular conductor and two concentric half-circular conductors arranged on a radius on a stationary insulating plate to form the second switch, and a brush arranged on the disc for electrically connecting one of the half-circular conductors with the annual conductor in dependence on the rotational angle of the disc, and conductors are arranged on a gear coupled with the motor to form the first switch, with which conductors three additional brushes come into contact, which brushes are arranged in a stationary manner in the structural unit.

In detail, the conductors for the three brushes lying against the modified gear comprise an annular segment and concentrically arranged half-circular segments in two different radii, which half-circular segments follow one another in the circumferential direction, whereby these conductor segments are defined or separated by insulating sections. Each conductor segment is associated with one of the three brushes. The brush on the annular conductor which contacts the modified gear is connected with one pole of a current source by means of the motor, while the two other brushes, which come into contact with the half-circular conductors of the modified gear are connected to respective half-circular conductors of the disc. The annular conductor of the disc is connected with the other pole of the current source. In this manner, both switches together form an alternating circuit, such that the electric motor is turned on by the brush on the disc, which motor rotates the modified gear until a brush slides off of one half-circular conductor, whereafter the motor stops, while another brush on the modified gear simultaneously comes into contact with its associated half-circular conductor, to thus prepare for a renewed turning on of the motor when there is a further rotation of the brush on the disc.

DETAILED DESCRIPTION OF THE INVENTION

Figure 1:
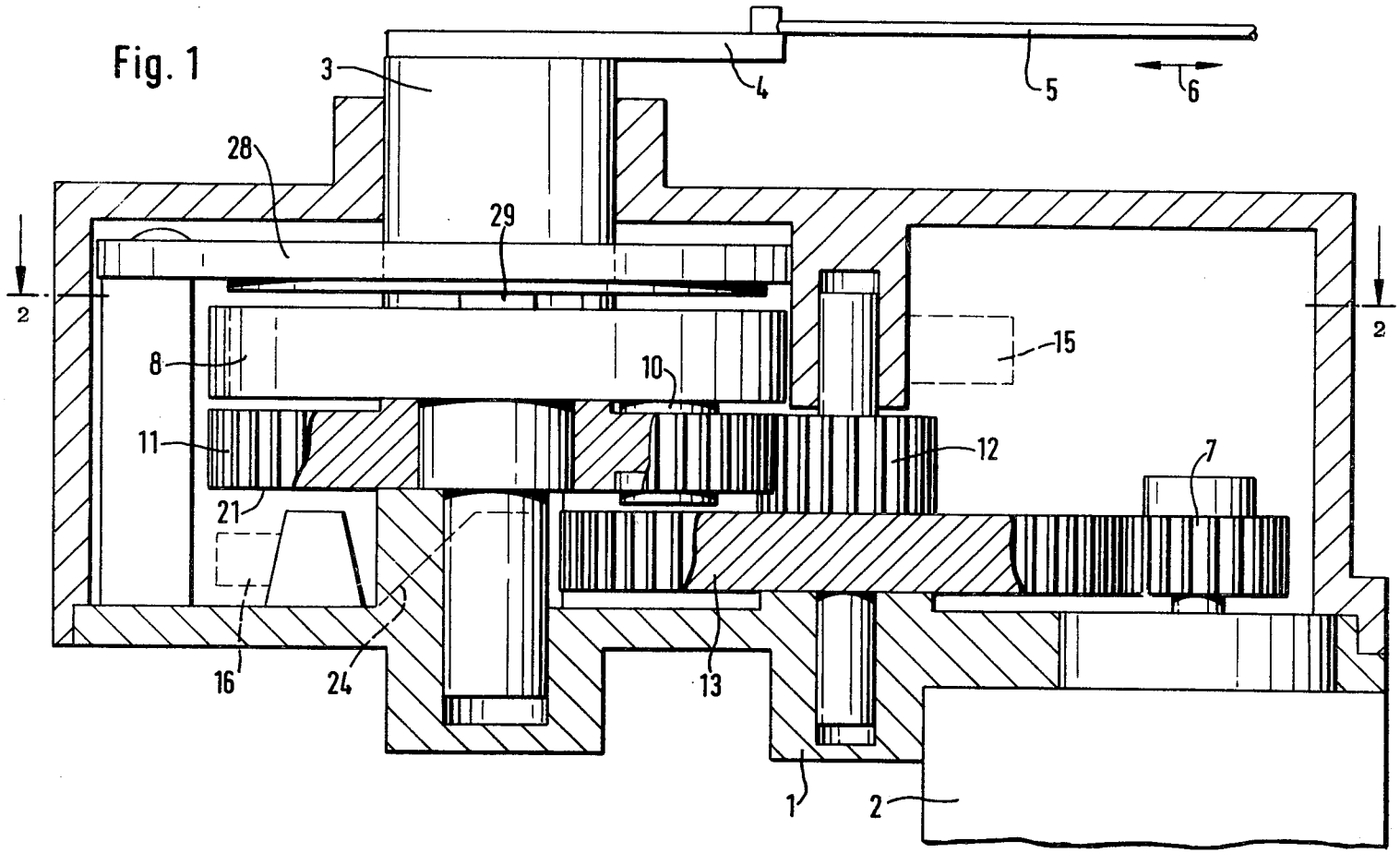
FIG. 1 is an enlarged sectional view of a first embodiment.
Figure 2:
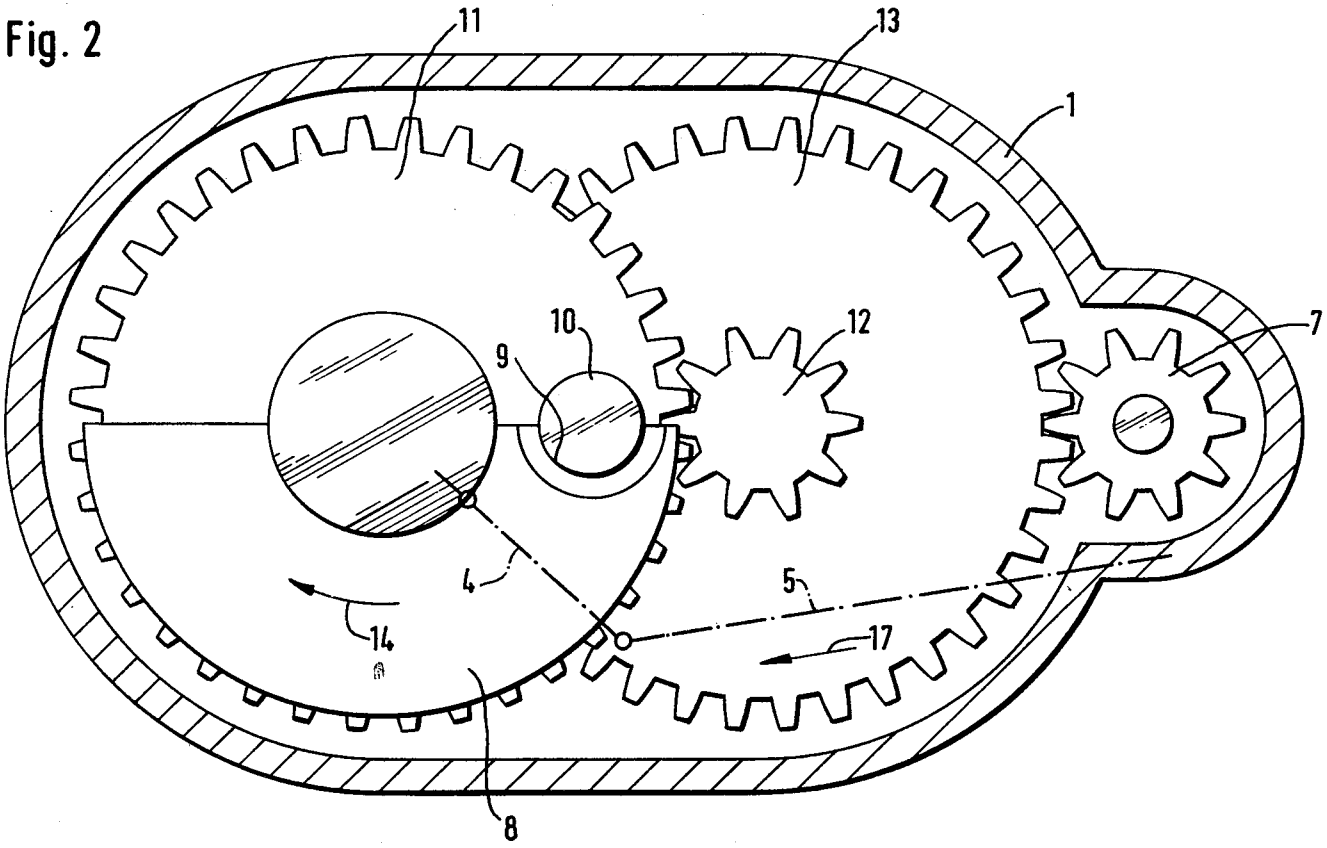
FIG. 2 is a section taken along the line 2—2 in FIG. 1, showing the apparatus in a first position.

In the drawings, wherein like reference numerals indicate like parts throughout the several views, a housing designated 1 in FIGS. 1 and 2 is mounted to a motor 2. The motor and the housing form a structural unit which also includes switches, an activating mechanism with activating elements for activating these switches, and gearing elements.

A drive shaft 3 is mounted in the housing, which drive shaft is connected with the motor 2 by means of gearing means. On the outside of the drive shaft is a crank 4, which in conjunction with a rod 5 serves as a connecting element to a lock mechanism (not shown), the direction of movement of the rod 5 being reversible in the direction of the double arrow 6 in dependence on the rotational path determined by a motor pinion 7.

A half-disc 8 is attached to the drive shaft 3 in the housing, which half-disc 8, as seen in FIG. 2, has a stop surface 9 for a bolt 10. The bolt 10 projects axially from one face of a gear 11, which gear 11 is mounted loosely on the drive shaft 3.

The gear 11 is connected with the motor pinion 7 by means of coaxial, stepped gears 12,13.

In the embodiment shown, only the half-disc 8 is thus connected with rod 5 by means of the drive shaft 3 and crank 4, which rod 5 leads to the lock mechanism. In contrast, the rod 5, the crank 4 and the drive shaft 3 are loosely connected with the gear 11 and thereby with the motor pinion 7, whereby the loose or lost motion connection between the bolt 10 in the gear 11 and the half-disc 8 is formed.

The half-disc 8 can rotate clockwise as indicated by arrow 14 relative to the bolt 10 without carrying along the gear 11. In contrast, the bolt 9 carries along the half-disc 8 when it is rotated in a clockwise direction, which translates the rotational movement into a reciprocating movement of the rod 5 by means of the crank.

Two switches (not shown in FIGS. 1 and 2), namely microswitches, can be provided to activate the motor 2, being embodied as reversing switches. The microswitch activated in dependence on the lock mechanism can thereby be arranged at position 15, in order to be activated by a cam (not shown) on the half-disc 8.

The microswitch activated in dependence on the rotational path of the motor 2, in contrast, can be arranged at position 16, in order to be activated by a cam (not shown) on the gear 11. The activating mechanism for the microswitches thus includes the half-disc 8 and the gear 11.

The activating mechanism cooperates with the microswitches at positions 15 and 16 in such a manner that the motor 2 is turned off in the position of the activating mechanism shown in FIG. 2.

Figure 3:
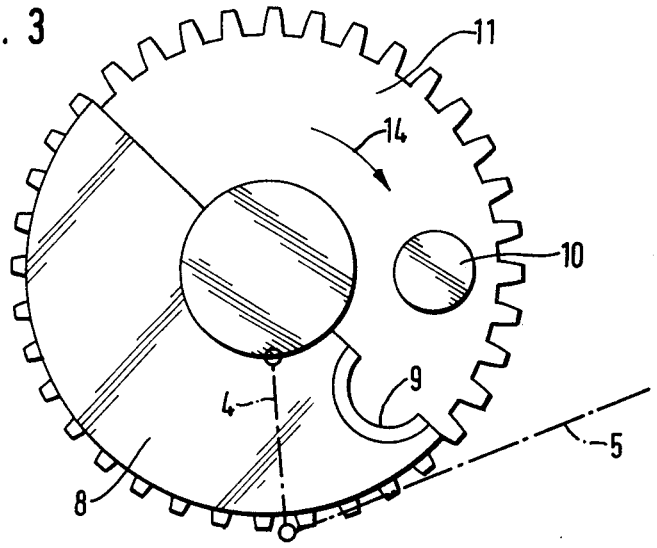
FIG. 3 is a fragmentary view of a portion of the apparatus of FIG. 2, showing the apparatus in a second position.

If by means of the introduction and rotation of a key in the lock mechanism (not shown) the rod 5 is pushed so that the half-disc 8 rotates clockwise into the position shown in FIG. 3, the stop surface 9 first leaves the bolt 10, so that this movement can take place with little force. In the position shown in FIG. 3, the microswitch at position 15 is activated in such a manner by the half-disc 8 that the motor 2 is turned on. The motor then rotates the gear 11 by means of the coaxial, stepped gears 12,13, so that the bolt 10 carries along the half-disc up to the position shown in FIG. 4. In this position, the gear 11 activates the microswitch at position 16, thus turning the motor 1 off, which, however, is ready for a renewed turning on by an activation of the lock mechanism transferred to the half-disc 8 by means of the rod 5.

Figure 4:
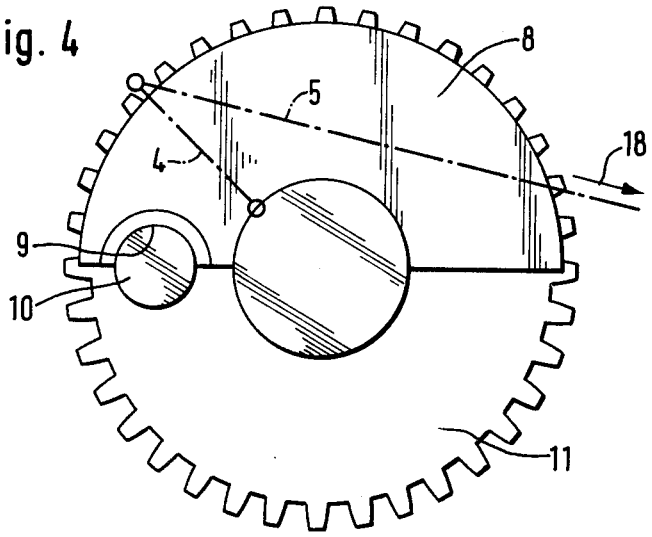
FIG. 4 is a fragmentary view similar to FIG. 3, showing the apparatus in a third position.

Thus the rod 5 in FIG. 2 is first pressed in the direction of the arrow 17 and then drawn by an electric motor in the same direction about to the position in FIG. 4. When a renewed manual activation of the lock mechanism then occurs, the rod 5 can be pulled in the direction of the arrow 18, whereby a reversal of direction has occured as compared to the arrow 17, and the rod 5 is pushed further in the direction of the arrow 18 to activate the lock mechanism.

Figure 6:
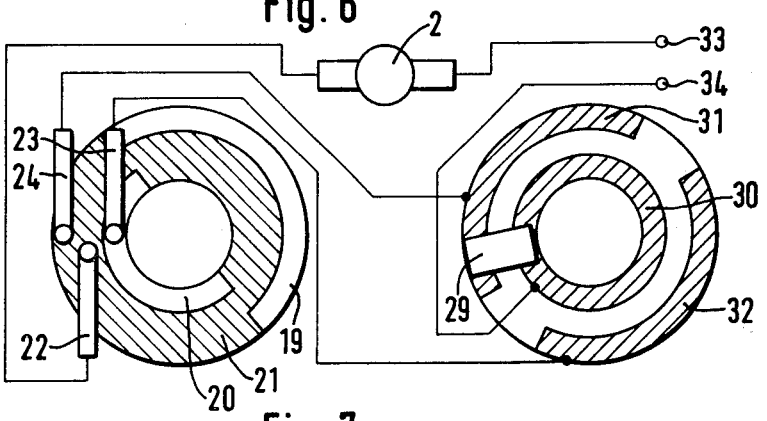
FIG. 6 is a view similar to FIG. 5, showing the switches in a second position.
Figure 7:
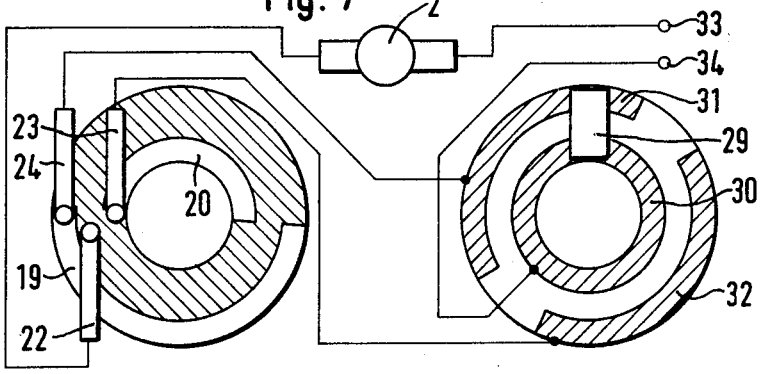
FIG. 7 is a view similar to FIG. 5, showing the switches in a third position.

Details of two switches integrated in the structural unit, and their function, are described below with the aid of FIGS. 5,6, and 7.

The switch which can be activated in dependence on the rotational path of the motor pinion 7 is basically constructed with the use of the gear 11, which is provided with insulating sections 19 and 20 on one frontal side 21 to form conductor segments. The insulating sections 19 and 20 are formed as half-circles, lie on different radii on the frontal side 21 and follow one another in the circumferential direction. Three brushes, 22,23,24 are pressed against the frontal side, whereby each brush is associated with one conductor. Only the brush 24 can be seen in FIG. 1. The brush 24 brushes on the outer conductor 25, which is interrupted by the insulating section 19. The brushh 22 brushes on a central conductor 26, which is formed as a continuous circle. The brush 23, finally, brushes on an inner half-circular conductor 27.

The first switch, which can be activated by the lock mechanism, is formed by a stationary insulating plate 28 on which other conductors are arranged, as well as by a brush 29 connected with the half-disc 8, see also FIG. 1. In detail, the insulating plate has an inner circular conductor 30 and two concentric half-circular conductors 31 and 32, which follow one another on the same radius while leaving intermediate spaces free. The two switches illustrated are reversing switches, which in connection with the motor 2 and a current source at terminals 33,34 form an alternating circuit.

Figure 5:
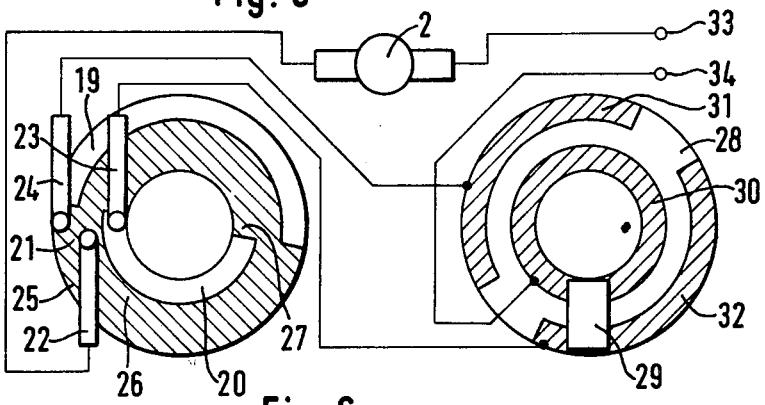
FIG. 5 is a somewhat schematic view of details of the first embodiment, showing two switches in a first position.

The position of the switches illustrated in FIG. 5 is the rest position, in which the motor 2 is not activated, because the current flow between the terminals 33 and 34 is interrupted; for the brush 23 of the first switch is contacting the insulating section 20. If, in contrast, the rod 5 is activated in direction 17 in FIG. 2, thus rotating the half-disc 8 and the brush 29 is brought into a position bridging the half-circular conductor 31 with the circular conductor 30, then there arises a current flow through the brushes 24 and 22 in the first switch, and the motor rotates the brush 29 further into the position shown in FIG. 6, the same as the gear 11 with the frontal side 21. This rotation stops until the current flow in the first switch is interrupted, because the insulating section 19 contacts the brush 24. Now, however, the apparatus is prepared for a renewed turning on by further rotation of the brush 29 of the second switch in a clockwise direction, because a contact is produced between the brush 23 and the brush 22 by means of the contact path 27.

Figure 8:
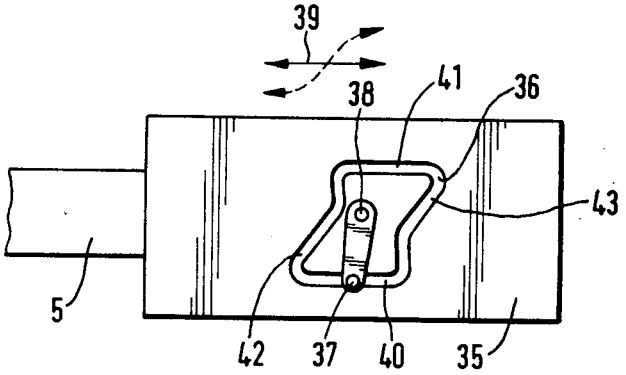
FIG. 8 is a schematic view showing basic portions of a second embodiment of the apparatus.

In the second embodiment of the apparatus for electric motor central locking according to FIG. 8, the rod leading to the lock mechanism is also designated with 5. Here, the rod ends in an element 35 with a guide slot 36. A lever arm 37 engages in the guide slot, which lever arm 37 has a shaft 38 which is connected with a motor (not shown) by means of an alternating drive (also not shown). A first switch (not shown), which is formed as a reversing switch, can be activated by the alternating drive, while a second switch (also not shown), which is also shown as a reversing switch, can be activated by the rod 5 or the element 35, namely in dependence on a manual setting of the lock mechanism.

The guide slot 36 basically comprises two slot sections 40 and 41, which are arranged adjacent each other and nearly parallel to the main direction of movement 39 of the rod, and which are connected with each other by means of two almost V-shaped connection section 42 and 43.

When the lock mechanism is locked by a manual actuation of the rod 5, there is at first almost no resistance to this movement, because, beginning from the position shown in FIG. 8, the guide slot 36 is freely movable relative to the lever arm 37, whereby the rod 5 or the element 35 activates a switch to turn on the motor, which results in a rotation of the lever arm 37. The lever arm then carries the rod further in the main direction of movement, after the lever arm arrives into the deepest position of the V-shaped guide slot section 42. In the course of further rotation of the lever arm, the lever arm is rotated laterally out into the flatter portion of the V-shaped guide slot in the slot section 41 running parallel to the main direction of movement, in which the motor is turned off by means of a switch (not shown) directly connected with the motor. Thereafter, the motor can again be turned on, if the rod 5 is pushed in the direction opposite the movement phase just considered, whereafter the motor rotates the lever arm 37 further clockwise, which lever arm 37, having arrived in the deepest point of the V-shaped slot section 43, pushes the rod in the direction opposite the main movement as in the previous movement phase to activate the lock mechanism. The lever arm 37 then rotates out of the V-shaped guide slot and arrives back in its original position illustrated in FIG. 8. It should be noted that the rod 5 and its element 35 are not only movable in the main direction of movement 39, but can also pivot vertical thereto, in order to follow the rotational movement of the lever arm 37 to a certain degree.

What is claimed is:

1. Apparatus for electrically locking and unlocking doors of a motor vehicle, comprising:

a motor mounted in one door of the vehicle;

a lock mechanism in the door for locking the door;

a connecting element coupling the motor with the lock mechanism;

switch means connected with the motor and the lock mechanism for controlling locking and unlocking functions of the motor in response to movement of the connecting element, said switch means including a first switch coupled with the motor to be actuated by operation of the motor, and a second switch coupled with the lock mechanism via the connecting element to be actuated by movement of the connecting element;

motion transmitting means connected between the motor and connecting element and constructed to reverse the direction of movement of the connecting element in dependence on the movement completed by the motor; and said switch means, motion transmitting means and motor being arranged in a structural unit.

2. Apparatus as claimed in claim 1, wherein the motion transmitting means comprises a gear train, and the motor imparts rotary motion thereto, said connecting element being connected to the gear train for reciprocating motion.

3. Apparatus as claimed in claim 2, wherein the connecting element is coupled with the motor through a lost motion connection via the gear train.

4. Apparatus as claimed in claim 3, wherein the gear train comprises an activating mechanism with activating elements connected to activate the first and second switches.

5. Apparatus as claimed in claim 1, wherein the activating mechanism includes a disc which activates the second switch, and which is rotatable relative to a drive element which activates the first switch, said angle defining the lost motion connection between the motor and the connecting element.

6. Apparatus as claimed in claim 5, wherein a bolt projects axially out of the drive element, and the disc is formed as a half-disc with a stop-surface for the bolt.

7. Apparatus as claimed in claim 6, wherein the bolt extends into an arcuate slot in the disc.

8. Apparatus as claimed in claim 7, wherein the drive element which activates the first switch is formed as a toothed gear of the gear train and the connecting element is coupled with the gear train via a drive shaft, which is, in turn, coupled to the motor via the lost motion connection.

9. Apparatus as claimed in claim 8, wherein a crank is arranged on the drive side of the gear train and is acted upon by the connecting element to reverse the direction of movement.

10. Apparatus as claimed in claim 6, wherein a second bolt projects out of the drive element at an angular distance to the first bolt.

11. Apparatus as claimed in claim 1, wherein the connecting element ends in an element provided with a guide slot, a lever arm engages in the guide slot, the lever arm is connected with a shaft driven by the motor by means of the motion transmitting means, and the element provided with the guide slot is formed as an activating element for activating the second switch.

12. Apparatus as claimed in claim 11, wherein the guide slot has two slot sections arranged next to each other nearly parallel to the main direction of movement of the connecting element, and two nearly V-shaped connecting sections connecting them.

13. Apparatus as claimed in claim 8, wherein components of both switches are integrated in the gear train.

14. Apparatus as claimed in claim 10, wherein an annular conductor and two half-circular annular conductors are arranged on a stationary insulating plate to form the second switch, and a brush is arranged on the disc, which brush electrically connects one of the half-circular conductors with the annular conductor, and additional conductors are arranged on a gear coupled with the motor to form the first switch, with which additional conductors three further brushes come into contact, which brushes are arranged in a stationary manner in the structural unit.

* * * * *